US006884148B1

(12) United States Patent
Dovek et al.

(10) Patent No.: US 6,884,148 B1
(45) Date of Patent: Apr. 26, 2005

(54) INDEPENDENTLY CONTROLLED READ AND WRITE HEAD STRIPE HEIGHT PARAMETERS IN SLIDER BACK END PROCESS

(75) Inventors: Moris Dovek, San Jose, CA (US); Wenjie Chen, Cupertino, CA (US)

(73) Assignee: Headway Technologies, Inc., Milpitas, CA (US)

( * ) Notice: Subject to any disclaimer, the term of this patent is extended or adjusted under 35 U.S.C. 154(b) by 20 days.

(21) Appl. No.: 10/854,652

(22) Filed: May 26, 2004

(51) Int. Cl.[7] ..... B24B 49/00
(52) U.S. Cl. ..... 451/5; 451/8
(58) Field of Search ..... 451/1, 5, 8, 11, 451/28; 29/603.1, 603.15, 603.16, 593

(56) References Cited

U.S. PATENT DOCUMENTS 5,772,493 A * 6/1998 Rottmayer et al. ..... 451/5
6,003,361 A * 12/1999 Amin et al. ..... 73/7
6,193,584 B1 * 2/2001 Rudy et al. ..... 451/5

* cited by examiner

*Primary Examiner*—Dung Van Nguyen
(74) *Attorney, Agent, or Firm*—George O. Saile; Stephen B. Ackerman

(57) ABSTRACT

A lapping guide system and method for lapping a merged read/write head are disclosed. The resistance $R_{RE}$ of a first ELG near the sensor in the read head is correlated to the resistance $R_{WE}$ of a second ELG and to the width of a first optical lapping guide (OLG) near the neck region of the write head. As the lapping progresses, $R_{WE}$ and $R_{RE}$ increase and the OLG width along the lapping plane increases. Thus, an OLG width and a $R_{WE}$ corresponding to a target neck height or throat height and a $R_{RE}$ corresponding to a target stripe height are determined. A lapping plane is actively tilted to enable write head dimensions to be independently controlled on a per wafer or per row basis. The first OLG is a triangular feature with one side parallel to the lapping plane and the other two sides converging near the lapping plane.

39 Claims, 4 Drawing Sheets

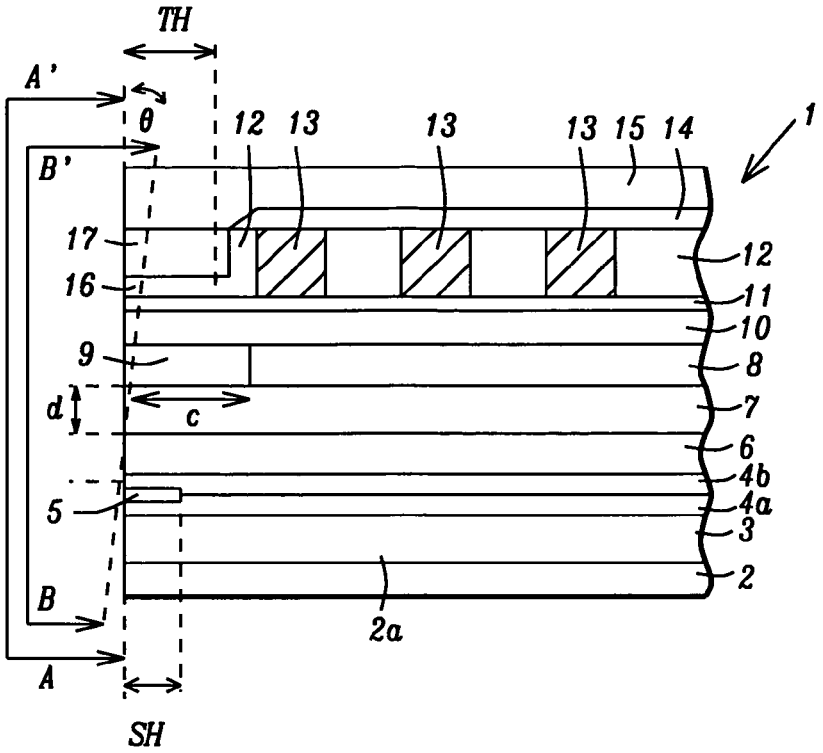
FIG. 1 – Prior Art
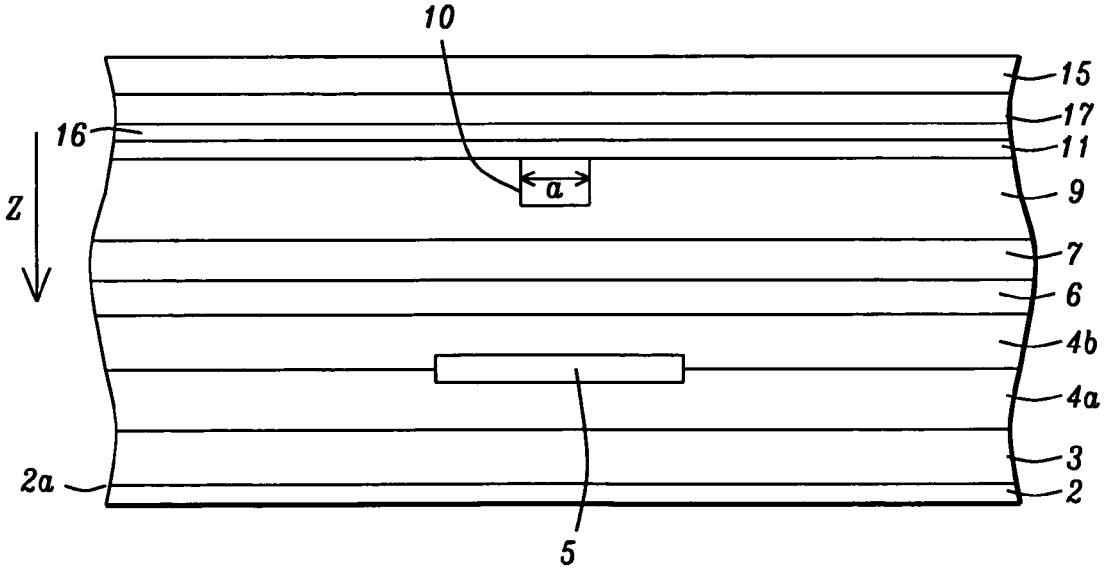
FIG. 2 – Prior Art

INDEPENDENTLY CONTROLLED READ AND WRITE HEAD STRIPE HEIGHT PARAMETERS IN SLIDER BACK END PROCESS

FIELD OF THE INVENTION

The invention relates to a method for independently controlling write head dimensions perpendicular to the ABS plane and read head stripe height during a lapping process and is also a system that includes an electrical lapping guide and an optical lapping guide in the plane of the write head for controlling the lapping process.

BACKGROUND OF THE INVENTION

When manufacturing magnetic heads for magnetic storage applications, a critical step is a milling (lapping) process in which material from one side of the head is trimmed to form an air bearing surface (ABS). Typically, a plurality of heads is arranged side by side in row that has been sliced from a substrate and mounted on a lapping plate in front of a lapping tool. Once the lapping process is complete, the row is diced to form individual heads. Each head is formed on a slider which in the final device is attached to a servo control unit that guides the head over a spinning recording medium during a read or write operation.

During the lapping process, a plurality of electrical lapping guides (ELGs) which were placed along the ABS in the preceding head fabrication steps and which are attached to a controller that guides the lapping tool are used to determine when the lapping process is complete. Typically, the read head is lapped along an ABS plane to provide an acceptable sensor stripe height (SH) which is the distance from the ABS to the back of the sensor. In a merged read/write head structure, nearby layers in the write head are simultaneously lapped to determine critical dimensions such as the throat height (TH) and neck height in the second pole piece of the write head. The neck height (NH) is the distance from the ABS to the back side of the neck region where the second pole piece begins to widen into the yoke region. The throat height is the distance from the ABS toward the back side of the yoke region where the second pole piece begins to separate from the first pole piece. Each of the SH, NH, and TH distances has a tight tolerance in order to optimize the magnetic head performance.

A typical ABS lapping process is designed to accurately control the read element stripe height alone and the control on some critical dimensions of the write head is therefore looser. The read head stripe height as well as the wafer level alignment usually dictates the write head neck height and throat height which cannot be independently controlled. Furthermore, any in-process misalignment between the wafer plane and the ABS lapping plane also results in added variations of some critical write head dimensions.

A conventional perpendicular magnetic recording (PMR) device with a merged read/write head 1 is depicted in FIG. 1. The read head is formed first on a substrate 2 that has a top surface 2*a*. There is a first shield layer 3 formed on the substrate 2 and first and second gap layers 4*a*, 4*b* consecutively formed on the first shield layer. Between the first and second gap layers 4*a*, 4*b* is a sensor 5 with a stripe height SH. A second shield layer 8 forms the top of the read head. The read head is separated from the write head by a separation layer 7 having a thickness d which is known as the read-write separation distance.

The bottom layer in the write head is a bottom yoke 8 which is recessed from the ABS plane A–A' by a distance c which is typically about 1 micron. Adjacent to the bottom yoke 8 on the separation layer 7 is formed a non-magnetic write gap layer 9 that extends from the ABS toward the back side of the write head. A main pole piece 10 on the write gap layer 9 has a width a in a pole tip region (FIG. 2) at the ABS and begins to diverge and form a wider width at a neck height distance NH from the ABS plane A–A'. There is successively formed a first insulation layer 11 and a second insulation layer 12 on the main pole piece 10. There is a plurality of coils 13 located within the second insulation layer 12 which are wrapped around a back gap region (not shown) where the main pole piece 10 joins a top yoke section 15. An overcoat dielectric layer 14 such as alumina typically covers the coils 13. Also shown are a first write shield layer 16 which is a magnetic layer that extends a distance TH from the ABS plane on the main pole piece 10 and a second write shield layer 17 between the first write shield layer and the top yoke 15.

Ideally, the lapping process results in an ABS plane A–A' which is perpendicular to the surface 2*a* of the substrate 2. However, due to lapping process variations, an ABS plane B–B' may be formed in which the throat height TH and neck height (not shown) in the main pole piece 10 will be shorter than the design value by a distance equal to $d \times \tan \theta$ where d is the read-write separation distance and $\theta$ is the misalignment angle. When d is large enough to place NH or TH below a minimum specified value, then the head may be scrapped since rework is not possible. Therefore, a means for controlling the lapping process is necessary that can independently control TH, NH, and SH.

Referring to FIG. 2, a cross-sectional view of the merged read/write head 1 is pictured from the ABS plane A–A'. The direction that the head moves over a recording medium is shown by the arrow z. The width a of the main pole piece 10 in a pole tip region at the ABS plane is another critical dimension because it is the track width. A higher recording density is achieved with a narrower track width but a more controlled lapping process is necessary to satisfy tight tolerances for SH, TH, and NH.

A dual element lapping guide system is disclosed in U.S. Pat. No. 6,027,397 and includes resistive elements superimposed on electrical switch elements in kerf areas. The resistive elements are aligned with the MR transducers and the electrical switch elements are aligned with the inductive magnetic transducers.

In U.S. Patent Pub. 2003/0200041, element like ELGs (ELEs) and ELGs are placed in alternating kerfs to improve stripe height calibration. Stripe height data is collected using ELGs and resistive data values are simultaneously collected using the ELEs.

In U.S. Pat. No. 6,609,948, an ELG is formed in the sensor material layer. Various films are employed for the ELG to minimize magnetoresistance and optimize the resistance of the ELG.

U.S. Pat. No. 6,193,584 describes an ELG in which a first resistive element is separated from a second resistive element by a common lead. The initial heights of the two resistive elements are different and are at least 15 microns larger than the target stripe height. This design provides different resistances during the lapping process.

SUMMARY OF THE INVENTION

One objective of the present invention is to provide a lapping method for independently controlling critical dimensions perpendicular to the ABS in a write head while also controlling stripe height in an adjacent read head.

A further objective of the present invention is to provide a system that includes electrical lapping guides and/or optical lapping guides for controlling a lapping process according to the first objective on a row by row basis or on a per wafer basis.

These objectives are achieved in a first embodiment by providing a merged read/write head in which a read head is formed on a substrate which is part of a slider and has a first ELG formed along the same first plane as a sensor. The first plane is perpendicular to the initial lapping plane. There is a write head comprised of a main pole layer formed above the read head. The main pole layer has a neck region with a thickness and a width (track width) at the lapping plane. Overlying the main pole layer and adjacent to the neck region is an upper write gap insulating layer. Adjacent to and below the main pole layer near the initial lapping plane is a lower write gap insulation layer. A key aspect is that a second ELG and preferably at least one optical lapping guide (OLG) feature are formed in the lower write gap insulation layer proximate to the neck region of the main pole layer. The second plane is parallel to the first plane and to the substrate surface. Preferably, the OLGs and ELGs are formed in the kerf area but may be located elsewhere on the slider.

A first OLG has a triangular shape with a first thickness and with sides formed on the second plane. One side is parallel to the initial lapping plane and final lapping (ABS) plane and the other two sides converge near the initial lapping plane. The second ELG is also formed on the second plane in the lower write gap insulation layer and proximate to the neck region. The second ELG is comprised of two conductive lines which are connected by a resistive element formed along the second plane at the initial lapping plane. The conductive lines extend from the initial lapping plane along the second plane in a direction parallel to the sides of the neck region. The resistive element has a first width between the conductive lines, a second thickness, and a length in a direction that is perpendicular to the initial lapping plane.

Optionally, the second ELG may be formed without the optical lapping guide or the optical lapping guide can be included in the merged head without the second ELG. Furthermore, there may be a second OLG feature in the shape of a rectangle that is on the second plane near the first OLG and with one end formed along the initial lapping plane. The second OLG has a first thickness, a second width along the initial lapping plane, and two sides that are parallel to the sides of the neck region. In a view from the initial lapping plane, the second ELG is preferably aligned above the first ELG. The first and second thicknesses are preferably thicker than the neck region and the first width is greater than the width of the neck region. The width of the first OLG along the second plane on the initial lapping plane may vary from about 0 to a width similar to the second width of the second OLG.

In one embodiment of a method of the present invention, one test row from a wafer is lapped to establish a correlation between the resistance of the first ELG ($R_{RE}$) to the resistance of the second ELG ($R_{WE}$) which both become larger as lapping time increases. Additionally, the width of the first OLG along the lapping plane increases with longer lapping times as the NH (and TH) distance is shortened. Thus, NH or TH may be correlated to the width of the first OLG on the test row and to $R_{WE}$ and $R_{RE}$. During the lapping process on subsequent rows, the lapping plane may be fixed at a predetermined angle similar to the one on the test row or may be allowed to actively tilt via commands from a controller that is linked to the first ELG and second ELG. In either case, target values for $R_{WE}$ and $R_{RE}$ are inputted along with original $R_{WE}$ and $R_{RE}$ measurements that indicate the starting NH and SH distances, respectively. The lapping process is terminated when the average $R_{WE}$ and $R_{RE}$ values of all the non-faulty ELGs reach a $R_{WE}$ and $R_{RE}$ target values. For applications where SH is very small, the lapping process may be terminated when the resistive element of the second ELG is entirely removed and the device becomes open.

The width of the second OLG may be used to check for instances where previous photo and track trimming processes produce a narrower track width or windage shift in the x direction without affecting feature dimensions such as NH in the y direction. In another embodiment, the width of the first OLG at the initial lapping plane on the test row is measured and the lapping plane is tilted to generate the correlation of $R_{RE}$ to $R_{WE}$ and $R_{RE}$ to first OLG width. This feature allows the lapping plane tilt to be adjusted on the same row in which the width of the first OLG is measured for correlation purposes.

BRIEF DESCRIPTION OF THE DRAWINGS

FIG. 1 is a cross-sectional view showing a conventional merged read/write head with a perpendicular lapping plane and another lapping plane tilted at an angle θ.

FIG. 2 is a cross-sectional view of the merged head in FIG. 1 from a lapping plane that shows the direction of head movement relative to a recording medium.

DETAILED DESCRIPTION OF THE INVENTION

Figure 3:
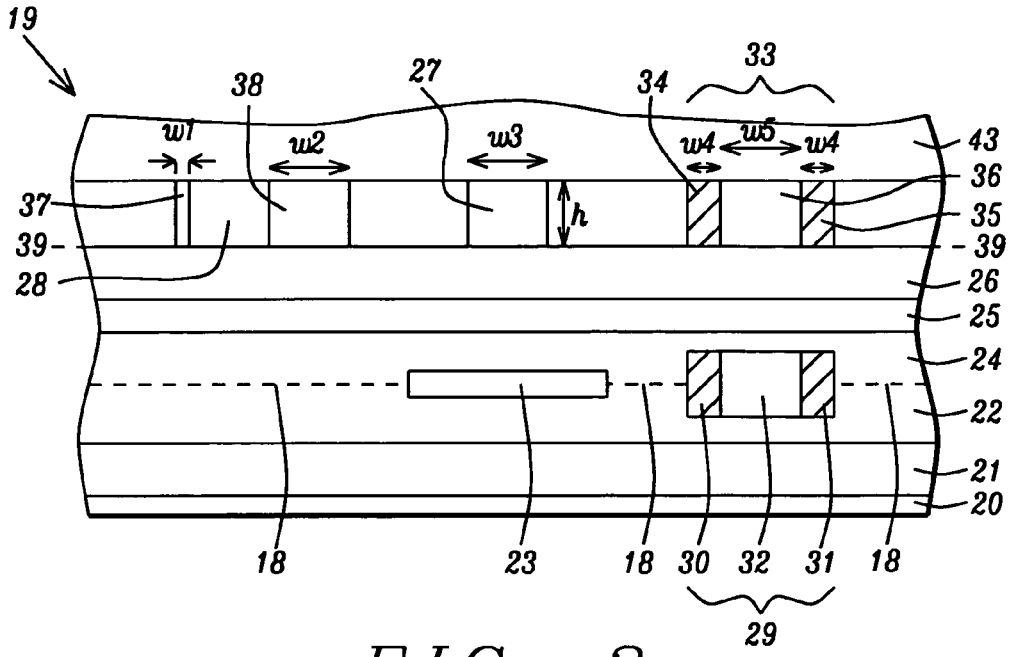
FIG. 3 is a cross-sectional view of a lapping guide system of the present invention in which a first ELG is formed near a sensor in a read head and a second ELG and one or more optical lapping guides are formed in a write head along a lapping plane.

The present invention involves an improved lapping guide system which enables independent control of the neck region dimensions that are perpendicular to the ABS in a merged read/write head. Although a perpendicular magnetoresistive (PMR) design is shown in the drawings, the present invention is equally applicable to other write head structures including a planar writer or a stitched pole writer. The drawings are provided by way of example and are not intended to limit the scope of the invention. Additionally, the figures are not necessarily drawn to scale and the relative sizes of the various elements may be different than in an actual device. The present invention is also a method for lapping a merged read/write head by employing the lapping guide system disclosed herein.

First, the lapping guide system of the present invention will be described. Referring to FIG. 3, a first embodiment is shown in a cross-sectional view from a lapping plane of a merged read/write head structure prior to the start of a lapping process. It is understood that the merged head structure is part of a slider and that an array of sliders are formed side by side in a row on a substrate. Typically, there is a plurality of rows fabricated on a substrate and the rows are sliced to produce bars in which the ends of the sensor and neck region in each merged head in a row are aligned along the lapping plane at the front side of a bar or lapping plate.

There is shown a merged head structure 19 fabricated on a substrate 20 that may be ceramic, for example. The read head portion of the merged head structure includes a first shield layer 21 formed on the substrate 20 and first and second gap layers 22, 24 consecutively formed on the first shield layer. Between the first and second gap layers 22, 24 is a sensor 23 with two sides that extend in a direction perpendicular to the lapping plane and toward the back side of the read head by a stripe height (SH) distance (not shown). The front end of the sensor 23 is shown at the lapping plane. A first electrical lapping guide (ELG) 29 comprised of conductive lines 30, 31 and a resistor element 32 is formed along the lapping plane and within the first and second gap layers 22, 24 in the proximity of the sensor 23. The conductive lines 30, 31 run parallel to the sides of the sensor 23 and extend toward the back side of the bar where they are connected to controller that is able to measure electrical resistance. Preferably, the distance between the sensor 23 and conductive line 30 is about 100 to 2000 microns. In one embodiment, the sensor 23 and first ELG 29 are intersected by a first plane 18—18 which is parallel to the surface of the substrate 20 and is perpendicular to the lapping plane. In a planar writer or a stitched pole writer, the top layer of the read head is the second shield 25 which also serves as the first pole piece layer of the overlying write head. The various layers within the read head are constructed using materials and methods well known to those skilled in the art and are not described herein.

In a PMR write head, a spacer layer 26 which is typically a non-magnetic material is formed on the second shield 25 and has a thickness of about 2 to 5 microns which is the separation distance between the read and write heads. A main pole layer comprised of a neck region 27 with a thickness h of 0.1 to 0.6 microns is formed so that the neck region is on the spacer layer 26 at the lapping plane. The main pole layer may be comprised of CoFe, CoNiFe, or CoFeX where X may be N or Ta. Note that the neck region 27 has a width $w_3$ of about 0.05 to 0.5 microns that will be equivalent to the track width in the finished write head. There is a lower write gap insulation layer 28 that is made of alumina, for example, formed on the spacer layer 26 and along the sides of the neck region 27. Above the lower write gap insulation layer 28 is an upper write gap insulation layer 43. Other elements in the write head such as coils and a write shield are not shown. Those skilled in the art will appreciate that the present invention is applicable to other write head configurations.

A key aspect of the present invention is that a first optical lapping guide (OLG) 37 and a second ELG feature 33 are formed in the lower write gap insulation layer 28 along the lapping plane and proximate to the neck region 27. In a preferred embodiment, the first OLG 37 and second ELG 33 are formed on a second plane 39—39 which is the top surface of the spacer layer 26. The second plane 39—39 is perpendicular to the lapping plane and parallel to the first plane 18—18. Optionally, a second OLG feature 38 having a rectangular shape is included adjacent to the first OLG 37 on the second plane 39—39 and along the lapping plane. Alternatively, the first OLG 37, second OLG 38, and second ELG 33 may be formed above the second plane 39—39 within the lower write gap insulation layer 28. However, the first OLG 37, second OLG 38, neck region 27, and second ELG 33 are preferably formed along the initial lapping plane. The location and shape of the second ELG 33 and the two OLG features 37, 38 are defined during the same sequence of patterning and etching steps which are used to fabricate the pole piece layer including the neck region 37.

Preferably, the second ELG 33 is aligned above the first ELG 29 and consists of conductive lines 34, 35 and the resistive element 36 which are comprised of the same magnetic material as in the neck region 27 and the main pole layer. Optionally, a different magnetic material of similar thickness may be employed as the second ELG 33. The conductive lines 34, 35 and resistive element 36 have a thickness h. In one embodiment, the width $w_4$ of conductive lines 34, 35 is from 1 to 20 microns and is about equivalent to the widths of conductive lines 30, 31 in the first ELG 29. The resistive element 36 has a width $w_5$ between the conductive lines of about 5 to 200 microns which is about equivalent to the width of the resistive element 32 in the first ELG 29. The first and second OLGs 37, 38 have a thickness h and are comprised of the same magnetic material that is used for the main pole layer or an alternate magnetic or non-magnetic metallic layer that is patterned simultaneously with the write pole (main pole layer). Preferably, the first and second OLGs 37, 38, the second ELG 33, and the neck region 27 have the same thickness. The width $w_1$ of the first OLG 37 at the initial lapping plane is about 0 to 2 microns and the width $w_2$ of the second OLG 38 is from 0.2 to 3 microns.

Figure 4:
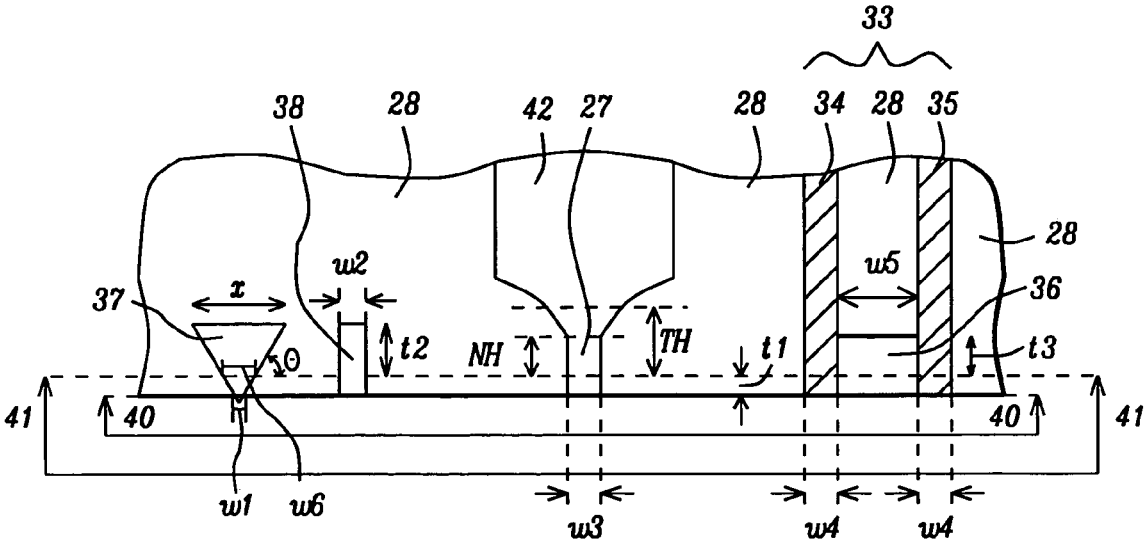
FIG. 4 is a top-down view of the lapping guide system depicted in FIG. 3 in which the upper write gap insulation layer and lower write gap insulation layer have been removed from the vicinity of the second ELG, optical lapping guides, and main pole layer.

Referring to FIG. 4, a top-down view of the merged head structure in FIG. 3 is shown in which the upper write gap insulation layer 43 has been removed from above the main pole layer 42, second ELG 33, and first and second OLGs 37, 38. The plane 40—40 is the initial lapping plane prior to the start of the lapping process. Alternatively, the initial lapping plane 40—40 may be a greater distance from the main pole layer 42 such that the initial lapping plane does not intersect the first OLG 37 or second OLG 38. The plane 41—41 is the ABS plane at the end of the lapping process in which a thickness $t_1$ is removed from the end of the substrate along the row of sliders. A critical step is determining when the removed thickness $t_1$ that is typically from 1 to 20 microns has been reached so that NH and TH are within a specification of about 0.1 to 0.5 microns. As mentioned previously, the ABS plane 41—41 is ideally perpendicular to the end of the neck region 27. It is understood that the distance between the OLG 37 and OLG 38 and the distance between the pole piece layer 42 and ELG 33 should be within one to two slider dimensions that also includes the kerf area between sliders. Although the OLGs 37, 38 and the ELGs 29, 33 are typically in the kerf area, they may be located elsewhere.

The present invention also encompasses a plurality of first OLGs 37, second OLGs 38, first ELGs 29, and second ELGs 33 formed along a row of sliders. For example, a set of lapping guides that includes a first OLG 37, a second OLG 38, a first ELG 29, and a second ELG 33 may be formed adjacent to each main pole layer in each read/write head along the row of sliders. Alternatively, a first ELG 29 may be formed without an overlying second ELG 33 or first OLG 37. However, whenever there is a second ELG 33 and a first OLG 37 in a write head, there is a first ELG 29 in an adjacent read head according to the present invention. Typically, about 20 to 40 first ELGs 29 and about 10 to 15 second ELGs 33 and first OLGs 37 are formed along a row of sliders.

For a perpendicular ABS plane 41—41, it is understood that the stripe height (SH) in the underlying sensor (not shown) is also adjusted by an amount $t_1$ during the lapping process. However, in the embodiment where an active tilt mechanism is employed to enable both first and second ELGs 29, 33 to meet specifications which will be explained in a later section, the underlying sensor SH will be reduced by an amount close to $t_1$ but not necessarily equal to $t_1$.

The first OLG 37 is a triangular feature wherein one side is parallel to the lapping plane 40—40, has a length x of about 10 to 50 microns, and is a distance $t_2$ of 10 to 50 microns from the ABS plane 41—41. The other two sides converge near the lapping plane and have a length of 10 to 50 microns which is not necessarily equal to x. In one embodiment as depicted in FIG. 4, the row is sliced so that there is a distance $w_1$ between the two converging sides at the initial lapping plane 40—40. An angle θ of about 300 to 600 is formed between a converging side and the initial lapping plane 40—40 (and ABS plane 41—41). Thus a small change in the $t_1$ will result in a large change in $w_6$ which is the width of the OLG 37 at the ABS plane 41—41.

When a second OLG 38 is included, the second OLG preferably has a rectangular shape with two sides that are perpendicular to the lapping plane 40—40 and with two ends wherein a first end is at the lapping plane 40—40 and a second end is a distance $t_2$ from the ABS plane 41—41. Alternatively, the first end may be proximate to but not necessarily at the initial lapping plane 40—40. In one aspect, the conductive elements 34, 35 in the second ELG 33 run perpendicular to the lapping plane 40—40 and parallel to the sides of the main pole layer 42 on the second plane 39—39. However, the second ELG 33 may also be formed above the second plane 39—39 and within the lower write gap insulation layer 28. The resistive element 36 extends a distance $t_3$ of about 0.1 to 5 microns from the ABS plane 41—41 and between the conductive lines 34, 35. In a preferred embodiment, the value of $t_3$ is larger than $t_1$ so that a large enough portion of the resistive element 36 remains after lapping to provide a meaningful resistance measurement. Moreover, $t_3$ is close to the NH dimension. In an alternative embodiment, $t_3$ is 0 so that when NH is reached, an open circuit is formed.

Figure 5:
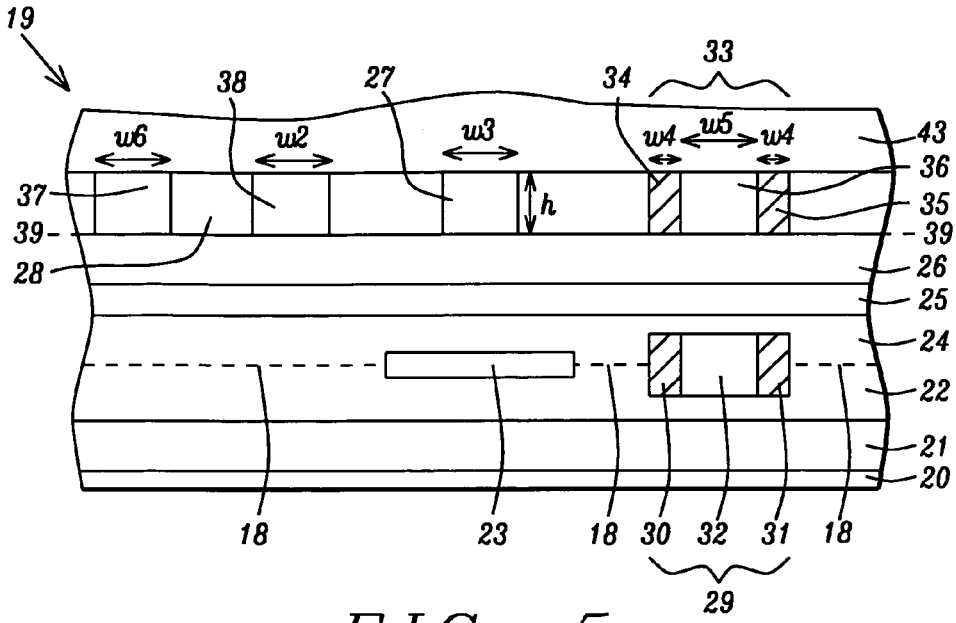
FIG. 5 is a cross-sectional view of the lapping guide system in FIG. 3 from the ABS plane after a lapping process is complete.

Referring to FIG. 5, a view from the ABS plane 41—41 in FIG. 4 is shown after the lapping process is completed. The width $w_2$ for the second OLG 38 and the width ($w_5$+ $2w_4$) for the second ELG 33 along the ABS plane remain unchanged. However, the width of the first OLG 37 has increased from $w_1$ in FIG. 3 to a width $w_6$ of about 0.2 to 3 microns after the lapping process is complete. An important feature of the present invention is that the change in width from $w_1$ to $w_6$ in the first OLG 37 during the lapping process correlates to a change in NH and TH values of the write head. Therefore, by measuring the width of the first OLG 37 along the lapping plane at any time during the lapping process, a value for NH and TH may be predicted and a correct termination point for the lapping process can be determined. Preferably, the width $w_6$ is about 2 to 10 times the size of the track width $w_3$. In the embodiment where the initial lapping plane does not intersect the first OLG 37, the width $w_1$ is reached at a certain time after the lapping process begins and the width of the first OLG 37 becomes the dimension $w_6$ when the lapping process is complete.

In an embodiment where the merged head has a planar write head component or a stitched throat recess and the critical perpendicular dimensions to the ABS plane are at different depths below a top yoke layer, those skilled in the art will appreciate that a plurality of ELGs and OLGs may be formed at different levels within an insulation layer that surrounds the write pole. For instance, one set of OLGs and an ELG may be fabricated in the insulation layer and on a first plane at a first distance below the top yoke layer where the first plane is perpendicular to the ABS and intersects a portion of a throat region near a pole tip. A second set of OLGs and an ELG may be formed in the insulation layer on a second plane at a second distance below the top yoke wherein the second plane is parallel to the first plane and intersects the neck region near a pole tip below the first plane. Although both sets of lapping guides could be monitored during the lapping process, this embodiment allows more flexibility in that one can decide to make adjustments using a particular set of lapping guides in the lapping process based on which value such as NH or TH is most out of alignment or based on which value is most sensitive and difficult to control.

A second embodiment of the present invention is a method of employing the lapping guide system of the first embodiment in a lapping process. As described previously, rows of sliders having merged head components are fabricated on a substrate. Typically, the rows are sliced to form bars that are mounted on lapping plates and a front side of each bar is lapped to generate an ABS on a merged head. Although the merged head is lapped under servo control primarily to achieve a targeted sensor height SH, the inventors have discovered that it is also possible to simultaneously control NH and TH by using the lapping guides described in the first embodiment.

In the present invention, a first step in achieving independent control of certain write head dimensions such as NH and TH in a lapping process is to form the read/write head structure with the novel lapping guide features according to the first embodiment. Another step in the lapping process is to slice a test row from a substrate and mount the row on a lapping plate by a conventional method. According to the second embodiment, the test row is then lapped to establish a primary correlation between the resistance $R_{WE}$ of a second ELG 33 and the width $w_6$ of a first OLG 37. In addition, a secondary correlation between the resistance $R_{RE}$ of a first ELG 29 and $R_{WE}$ is established. Referring again to FIG. 4, the most accurate method of correlating a lapping guide dimension to a neck height NH is to measure the width of the previously described first OLG 37 along a lapping plane 40—40, along the ABS plane 41—41, and/or along a lapping plane therebetween during the lapping process. However, the widths $w_1$ or $w_6$, for example, cannot be measured on every row because a metrology measurement requires the removal of a row from its mounted position on a lapping plate.

Referring again to FIG. 3, a cross-sectional view from the lapping plane is provided of a merged head structure according to the first embodiment in which a first ELG 29 is formed near a sensor 23 in the read head. As an example, the first ELG 29 is formed along the same plane 18—18 as the sensor 23. The plane 18—18 is parallel to the substrate 20 and in this case coincides with the top surface of the first gap layer 22. Optionally, the first ELG 29 and sensor 23 could be formed along another plane (not shown) that is within one of the gap layers 22, 24 and above or below the plane 18—18 and which is parallel to the substrate 20. The first ELG 29 is typically in the kerf area between sliders but may be located elsewhere.

There is a second ELG 33 aligned above the first ELG 29 which is formed within the lower write gap insulation layer 28 and proximate to the neck region 27. In a preferred embodiment, the neck region 27, second ELG 33, first OLG 37, and an optional second OLG 38 are formed along the same plane 39—39 and have a thickness h. Note that the width $w_1$ of the first OLG 37 may be close to 0 and is generally too small to be measured reliably when two sides of the first OLG 37 intersect at the lapping plane. Alternatively, the slice that forms the initial lapping plane does not intersect the first OLG 37 or second OLG 38 so that a dimension $w_1$ or $w_2$ is not formed along the initial lapping plane. In any case, as the test row is lapped, the lapping process is interrupted at a plurality of points in order to measure the width of the first OLG 37 at the lapping plane which gradually grows from about 0 to a value we as shown in FIG. 5. Other dimensions $w_2$–$w_5$ along the ABS plane in FIG. 5 have the same values as in FIG. 3 before the lapping process begins.

The widths $w_1$, $w_6$ are measured by a high resolution optical microscope or by a scanning electron microscope (SEM) which are routinely used in the art. The metrology tool is connected to a controller (not shown) which is linked to the lapping tool and issues commands that terminate the lapping process and adjust the lapping plane angle, for example. Meanwhile, at the original lapping plane and at each stopping point where the width of a first OLG 37 is measured on the test row, the resistance $R_{RE}$ of the first ELG 29 and the resistance $R_{WE}$ of the second ELG 33 are also monitored by the controller that is linked to the conductive lines in each first and second ELG 29, 33. A linear plot is obtained for the correlation $1/R_{WE}$ vs. $w_6$. Note that a correlation between $1/R_{RE}$ and $w_6$ may be determined, also.

Referring again to FIG. 4, the lapping process on the test row proceeds from the original lapping plane 40—40 to a final lapping (ABS) plane 41—41 which are separated by a distance $t_1$. Preferably, the NH and TH values are within specified limits at the plane 41—41. The resistance values $R_{RE}$ and $R_{WE}$ increase as the length of the resistive element 36 decreases from $(t_3+t_1)$ to $t_3$ while the width of the first OLG 37 along the lapping plane increases to $w_6$ during the lapping process. Furthermore, the width of the first OLG 37 is proportional to the neck height NH. In other words, as the width of first OLG 37 increases from about 0 to $w_6$, the neck height is reduced from $(NH+t_1)$ to NH.

Once the correlation between $R_{WE}$ and $w_6$ is established on a test row, a target $R_{WE}$ and a target $R_{RE}$ are set and an active tilt control is used to reach the target $R_{WE}$ and a target $R_{RE}$ on subsequent rows that are lapped. If an active tilt control is too costly, a passive tilt control may be employed which involves setting a predetermined tilt angle $\alpha$ as explained later with respect to FIG. 7. Preferably the width $w_6$ is from 2 to 10 times the size of the track width $w_3$. The neck height NH is also proportional to $R_{WE}$ and there is a target $R_{WE}$ value and a target $R_{RE}$ value that corresponds to a targeted neck height as determined by the test row correlation results.

In one embodiment, a total of about 20 to 40 first ELGs 29 and about 10 to 15 second ELGs 33 and first OLGs 37 are formed along a row of sliders. All first and second ELGs 29, 33 that are deemed not faulty are monitored. The lapping process on subsequent rows is typically stopped by the controller when the average values for all the non-faulty ELGs reaches the target values for set for $R_{WE}$ and $R_{RE}$.

Figure 6:
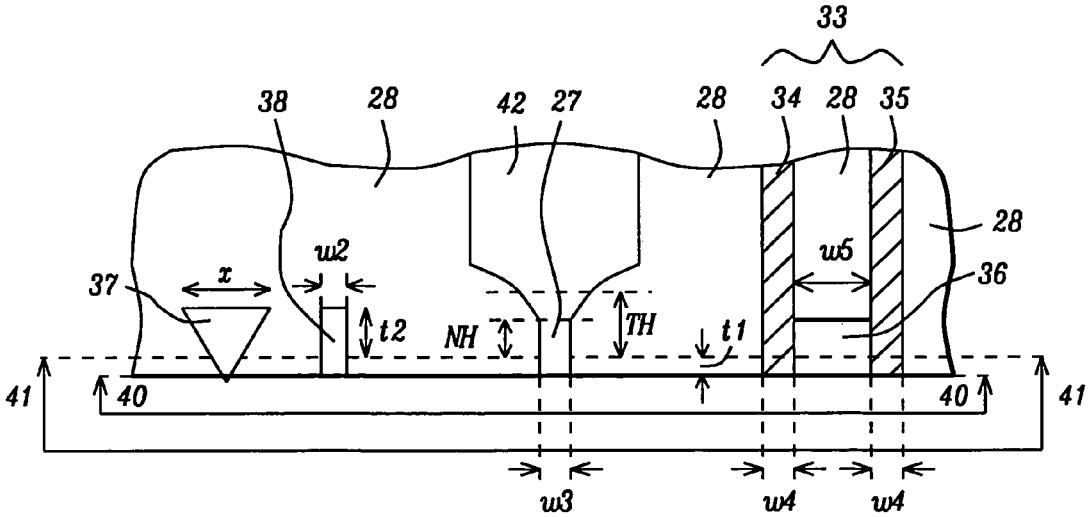
FIG. 6 is a top-down view of an alternative embodiment of the present invention in which the second ELG has a lap through feature along a lapping plane.

In an alternative embodiment depicted in FIG. 6, the second ELG 33 may be formed near the neck region 27 such that the distance of the back side of the resistive element 36 from the initial lapping plane 40—40 is about equal to $t_1$ so that $t_3$=0. As a result, the resistive element 36 is completely removed by the lapping process and $1/R_{WE}$=0 at the point when the neck height NH reaches a targeted value. An electrical circuit is broken when the resistive element 36 is lapped through and this event alerts the controller to stop the lapping process. This alternative control method may be preferred when a very short stripe height SH is required and additional sensitivity is needed during the lapping process.

Figure 7:
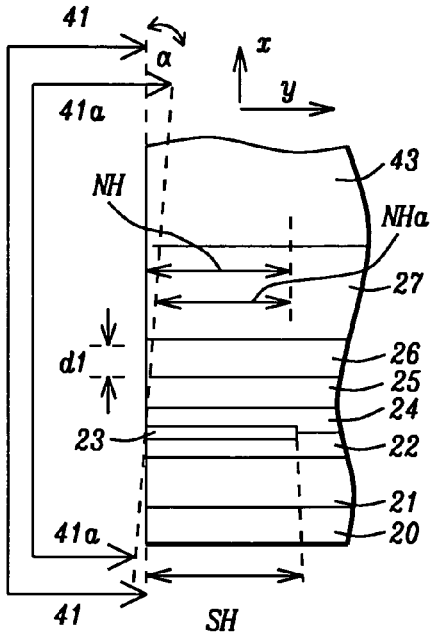
FIG. 7 is a cross-sectional view of a lapping guide method of the present invention in which the lapping plane is tilted at an angle α that is not perpendicular to the substrate.

Referring to FIG. 7, the ABS plane 41—41 is shown perpendicular to the plane of the substrate 20 after lapping a test row or subsequent rows. In an alternative embodiment, the ABS plane 41*a*—41*a* may be tilted slightly at an angle $\alpha$ to compensate for a misalignment in the y direction when forming the neck region 27 above the sensor 23. Accordingly, a larger portion of the neck region 27 must be removed than when a correct overlay occurs in order to reach a neck height NHa value that is within specified limits. In one mode, a target $R_{RE}$ value corresponding to a targeted stripe height SH and a target $R_{WE}$ value corresponding to a desired NH are inputted into a controller that regulates the lapping process. The lapping angle is allowed to tilt and be actively controlled by the controller until the lapping is stopped when both a target $R_{RE}$ value and a $R_{WE}$ value are reached. Optionally, the lapping plane is tilted to a predetermined angle $\alpha$ to tune in a critical write head dimension for each wafer (substrate) or on a per row basis. It is understood that instead of a single target $R_{RE}$ value and a single $R_{WE}$ value, a range of acceptable values for $R_{RE}$ and $R_{WE}$ may be inputted that correspond to a range of SH and NH values within specified limits.

Alternatively, the lapping plane may be tilted to an angle "$-\alpha$" when there is a misalignment in the "−y" direction when forming the neck region 27 above the sensor 23. A typical range for the tilting angle $\alpha$ is from about −3° to +3°.

During some fabrication processes, the patterning and etching processes which form the neck region cause a windage shift along the x axis which is perpendicular to the y axis and parallel to the ABS plane 41—41. In so doing, the track width may be overtrimmed without misaligning the neck region in the y direction. The first OLG 37 and second OLG 38 will also have a similar windage shift along the x axis since they are formed during the same patterning and etch operations as the main pole layer. Although an "x" windage shift could be determined by measuring the width of the neck region 27 at the ABS, the width of the neck region is generally quite small. More reliable "x" windage shift information is obtained by measuring the width $w_2$ for the second OLG 38 which is of a similar size to the width $w_6$ of the first OLG 37 at the ABS plane 41—41 (FIG. 4). In other words, the width $w_2$ of the second OLG 38 provides a better indication of the windage shift in the first OLG 37 than the width of the neck region 27 at the ABS plane. Therefore, the contribution of "x" windage shift to the $w_1$ and $w_6$ values during a test row measurement is known more accurately which in turn improves the correlation of $w_6$ to $R_{RE}$ and $R_{WE}$ so that more reliable target values for $R_{RE}$ and $R_{WE}$ are used for subsequent rows that are lapped.

Figure 8:
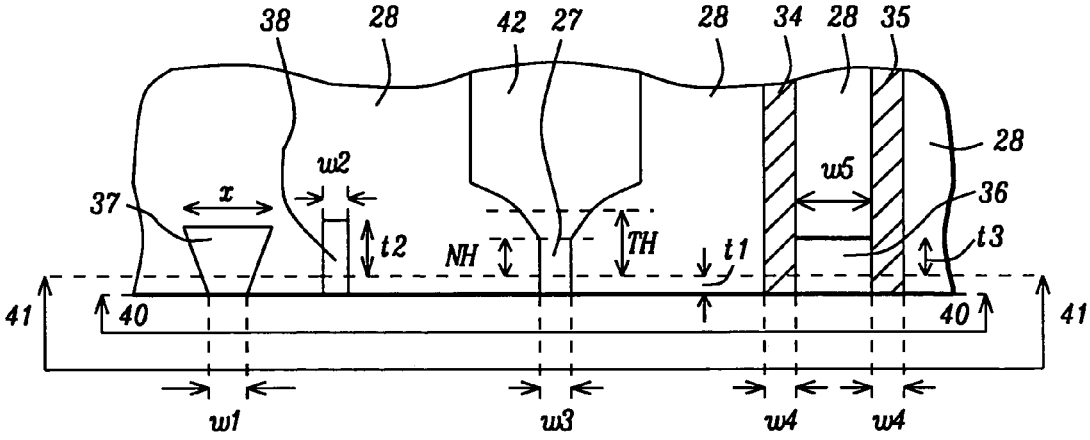
FIG. 8 is a top-down view of another embodiment of the lapping guide system of the present invention in which a first optical lapping guide (OLG) is shifted toward the initial lapping plane to allow a tilted lapping plane correction on the same row where a correlation between first ELG resistance and first OLG width is determined.

Referring to FIG. 8, a correction in the lapping plane tilt on the test row may be accomplished by shifting the location of the first OLG 37 toward the lapping plane. In this embodiment, the slice which forms the initial lapping plane 40—40 also generates an initial width $w_1$ for the first OLG 37 that is easily measured. The lapping plane is then tilted at an angle $\alpha$ as the test row is lapped to reach an ABS plane. Once a test row is lapped to establish a correlation of $w_5$ to $R_{RE}$ and $R_{WE}$ values, a target $R_{RE}$ and a target $R_{WE}$ are set and the lapping plane 41*a*—41*a* is tilted at an angle $\alpha$ for the lapping process on subsequent rows. The angle $\alpha$ is typically between −3° and +3°.

Preferably, if the value $w_1$ is below a target value after lapping a first row, the tilt needs to be adjusted so that the write head is closer to the lapping plane than the read head. On the other hand, if the value $w_1$ is larger than a target value, the tilt needs to be adjusted so that the read head is closer to the lapping plane than the write head. The tilt is proportional to $(w_1 \text{ target} - w_1 \text{ measured})/(d_1 \times \tan\{90-\alpha\})$ where $d_1$ is the read-write separation distance which is the thickness of the spacer layer 26 in FIG. 7.

One advantage of the present invention is that neck height and throat height are controlled independently of sensor height in merged head designs. The method of the present invention is able to compensate for misalignment error by allowing the lapping plane to be tilted to adjust NH or TH while maintaining SH within specification. The additional degree of lapping control leads to higher product yields because rejected heads in which SH is within specification but NH or TH is too short are avoided. Furthermore, a tighter tolerance for NH and TH dimensions are achieved because tuning of write head dimensions on a row by row basis is possible.

While this invention has been particularly shown and described with reference to, the preferred embodiment thereof, it will be understood by those skilled in the art that various changes in form and details may be made without departing from the spirit and scope of this invention.

We claim:

1. A lapping guide system for use in a lapping process of a magnetic read/write head formed on a substrate, said lapping process forms an ABS plane, comprising:

(a) a first electrical lapping guide (ELG) formed along a first plane proximate to a sensor in the read head on said substrate, said first plane is perpendicular to a lapping plane;

(b) a second ELG formed along a second plane proximate to a neck region of a main pole layer in the write head; said second plane is parallel to said first plane; and (c) a first optical lapping guide (OLG) having a triangular shape and a thickness formed on the second plane, said first OLG has one side parallel to said lapping plane and the other two sides converging near the lapping plane.

2. The lapping guide system of claim 1 further comprised of a second optical lapping guide feature having a rectangular shape formed on the second plane and along the lapping plane and which is used to detect an overtrim condition which is a windage shift in a direction parallel to the lapping plane for features formed on said second plane.

3. The lapping guide system of claim 2 wherein the first and second OLGs extend a distance of about 10 to 50 microns from the lapping plane in a direction parallel to the neck region on the second plane and have the same thickness as the second ELG and neck region.

4. The lapping guide system of claim 1 wherein the merged read/write head is a perpendicular magnetoresistive head or is comprised of a planar writer or a stitched pole writer.

5. The lapping guide system of claim 1 wherein the second ELG is comprised of a resistive element that has a width along the lapping plane of about 5 to 200 microns, a length perpendicular to the width and parallel to the neck region of about 1 to 25 microns, and a thickness of about 0.1 to 0.6 microns.

6. The lapping guide system of claim 1 wherein the side of the first OLG that is parallel to the lapping plane has a length of about 10 to 50 microns.

7. The lapping guide system of claim 1 wherein the thickness of the first OLG is about 0.1 to 0.6 microns.

8. The lapping guide system of claim 1 wherein the first OLG is comprised of the same magnetic material that is used for said main pole layer or an alternate magnetic or non-magnetic metallic layer that is patterned simultaneously with the main pole.

9. The lapping guide system of claim 1 wherein resistance measurements of the first ELG are used to control stripe height of a sensor in the read head during a lapping process.

10. The lapping guide system of claim 1 wherein resistance measurements of the second ELG are used to control neck height and throat height in the write head during a lapping process.

11. The lapping guide system of claim 1 wherein an angle $\theta$ of about 30° to 60° is formed at the intersection of said ABS and a side of the first OLG that is not parallel to the first plane.

12. The lapping guide system of claim 1 wherein measurements of the width of the first OLG along a lapping plane are correlated to resistance measurements of the first ELG and second ELG.

13. The lapping guide system of claim 1 wherein the first ELG and second ELG have an equivalent thickness and width along the first plane.

14. The lapping guide system of claim 1 wherein the second ELG is comprised of the same magnetic material that is used for said main pole layer or a different material of similar thickness.

15. A method of lapping a row of magnetic read/write heads formed on a substrate, said lapping forms an ABS plane, comprising:

(a) correlating the resistance $R_{RE}$ of a first electrical lapping guide (ELG) formed on a first plane and along a lapping plane in a read head to the resistance $R_{WE}$ of a second ELG and to the width of a first optical lapping guide (OLG) having a triangular shape wherein said second ELG and first OLG are formed along the lapping plane in an adjacent write head; and (b) lapping said row of magnetic read/write heads until a $R_{RE}$ resistance value corresponding to an acceptable stripe height of a sensor is reached and until a $R_{WE}$ resistance value corresponding to an acceptable critical dimension in the write head is reached.

16. The method of claim 15 wherein the second ELG and first OLG are formed on a second plane that is proximate to a neck region of the write head, said second plane is parallel to said first plane and to said substrate.

17. The method of claim 16 wherein the triangular shape of the first OLG is comprised of one side that is formed parallel to the lapping plane and perpendicular to the second plane and two other sides that are perpendicular to the second plane and which converge near the lapping plane.

18. The method of claim 17 wherein the side of the first OLG that is parallel to the lapping plane has a length of about 10 to 50 microns and is located a distance of about 10 to 50 microns from the ABS plane at the end of the lapping process.

19. The method of claim 16 wherein the second ELG is comprised of a resistive element that has a width along the lapping plane of about 5 to 200 microns, a thickness of about 0.1 to 0.6 microns, and a length perpendicular to the lapping plane along the second plane of about 1 to 25 microns.

20. The method of claim 15 wherein the merged read/write head is a perpendicular magnetoresistive head, a planar writer, or a stitched pole writer.

21. The method of claim 15 wherein the lapping plane is allowed to actively tilt during the lapping process to independently control a write head dimension.

22. The method of claim of claim 15 wherein said acceptable critical dimension relates to a neck height or throat height in the write head.

23. The method of claim 15 wherein the first OLG has a thickness of about 0.1 to 0.6 microns and is comprised of the same magnetic material as in a main pole layer of the write head or is an alternate magnetic or non-magnetic metallic layer that is patterned simultaneously with the main pole.

24. The method of claim 15 wherein the first OLG and second ELG are defined during the same patterning and etching sequence that defines the critical write head features including the neck region.

25. The method of claim 15 wherein step (b) involves actively tilting the lapping plane under servo control to achieve an acceptable stripe height dimension and an acceptable write head dimension.

26. The method of claim 15 wherein the lapping plane is tilted to a predetermined angle to tune in a critical write head dimension on a per wafer (substrate) basis or for each row on a substrate.

27. A method of lapping a row of magnetic read/write heads formed on a substrate, said lapping forms an ABS plane, comprising:

(a) correlating the resistance $R_{RE}$ of a first electrical lapping guide (ELG) formed on a first plane along a lapping plane in a read head to the resistance $R_{WE}$ of a second ELG and to the width of a first optical lapping guide (OLG) formed along the lapping plane in an adjacent write head on a test row on said substrate to determine target values for $R_{RE}$ and $R_{WE}$;

(b) adjusting the tilt of the lapping plane by a controller that has target values for stripe height of a sensor in the read head and for critical dimensions perpendicular to the lapping plane in the write head while lapping a row on said substrate; and (c) lapping said row until a $R_{RE}$ resistance corresponding to an acceptable stripe height is reached and until a $R_{WE}$ resistance corresponding to an acceptable critical dimension in the write head is reached.

28. The method of claim 27 wherein the second ELG and first OLG are formed on a second plane proximate to a neck region of the write head, said second plane is parallel to the first plane and to said substrate.

29. The method of claim 28 wherein the first OLG has a triangular shape with one side formed parallel to the lapping plane and perpendicular to the second plane and wherein the other two sides are perpendicular to the second plane and converge near the lapping plane.

30. The method of claim 29 wherein the side of the first OLG that is parallel to the lapping plane has a length of about 10 to 50 microns and is located a distance of about 10 to 50 microns from the ABS plane at the end of the lapping process.

31. The method of claim 28 wherein the second ELG is comprised of a resistive element that has a width along the lapping plane of about 5 to 200 microns, a thickness of about 0.1 to 0.6 microns, and a length perpendicular to the lapping plane along the second plane of about 10 to 50 microns.

32. The method of claim 27 wherein the lapping plane is adjusted during the lapping process to independently control a write head dimension.

33. The method of claim of claim 27 wherein said acceptable critical dimension relates to a neck height or throat height in the write head.

34. The method of claim 27 further comprised of measuring the width of a second OLG having a rectangular shape that is formed along the lapping plane and which is used to detect an overtrim condition which is a windage shift in a direction parallel to the lapping plane for features formed in the write head.

35. The method of claim 34 wherein the first OLG and second OLG have a thickness of about 0.1 to 0.6 microns and are comprised of the same magnetic material as in a main pole layer of the write head or from an alternate magnetic or non-magnetic metallic layer that is patterned simultaneously with the main pole.

36. The method of claim 34 wherein the second ELG, first OLG, and second OLG are defined during the same patterning and etching sequence that defines the critical write head features including the neck region.

37. The method of claim 27 wherein step (c) involves allowing the lapping plane to actively tilt under servo control to achieve an acceptable stripe height dimension and an acceptable write head dimension.

38. The method of claim 27 wherein the lapping plane is set at a predetermined angle during the lapping process to tune in a critical write head dimension for each row on a substrate.

39. The method of claim 27 wherein the resistance $R_{WE}$ goes to infinity to indicate complete removal of a resistive element and signals the controller to stop the lapping process.

* * * * *